US010292444B2

(12) United States Patent
Dotzenrod

(10) Patent No.: US 10,292,444 B2
(45) Date of Patent: May 21, 2019

(54) NOVELTY HAT WITH MAGNETIC ATTACHMENT

(71) Applicant: Best 2U LLP, Battle Lake, MN (US)

(72) Inventor: Joel Dotzenrod, Battle Lake, MN (US)

( * ) Notice: Subject to any disclaimer, the term of this patent is extended or adjusted under 35 U.S.C. 154(b) by 47 days.

(21) Appl. No.: 15/414,359

(22) Filed: Jan. 24, 2017

(65) Prior Publication Data

US 2018/0206575 A1 Jul. 26, 2018

(51) Int. Cl.
*A42B 1/24* (2006.01)
*A47G 23/02* (2006.01)

(52) U.S. Cl.
CPC ..... *A42B 1/24* (2013.01); *A47G 23/0266* (2013.01); *A47G 2023/0291* (2013.01); *A47G 2200/106* (2013.01)

(58) Field of Classification Search
CPC ..... A42B 1/24; A42B 1/02
See application file for complete search history.

(56) References Cited

U.S. PATENT DOCUMENTS 459,942 A * 9/1891 Brown ..... 2/181
4,268,567 A * 5/1981 Harmony ..... B29C 63/06 150/901
4,282,279 A * 8/1981 Strickland ..... B65D 25/34 150/901
4,399,668 A * 8/1983 Williamson ..... B65D 81/3883 215/12.1
4,540,611 A * 9/1985 Henderson ..... B65D 23/08 150/901
4,611,355 A * 9/1986 Galanto ..... A42B 1/248 2/209.13
4,671,424 A * 6/1987 Byrns ..... B65D 81/3886 220/592.16
4,768,232 A * 9/1988 Villalobos ..... A42B 1/006 2/161.1
4,776,043 A * 10/1988 Coleman ..... A42B 1/248 2/195.1
4,873,726 A * 10/1989 Tapia ..... A42B 1/064 2/10
5,107,548 A * 4/1992 Dotzenrod ..... A42B 1/008 2/195.1
5,996,116 A * 12/1999 Tate ..... A01K 97/06 2/12
6,175,963 B1 * 1/2001 Loeffelholz ..... A41D 27/08 2/200.1
2006/0005361 A1 * 1/2006 O'Banion ..... A42B 1/24 24/303
2009/0265837 A1 * 10/2009 Cunliffe ..... A42B 1/24 2/244
2013/0047317 A1 * 2/2013 Hanover ..... A42B 1/24 2/209.12
2015/0040291 A1 * 2/2015 Cho ..... A42B 1/24 2/195.1
2015/0327613 A1 * 11/2015 Kay ..... A42B 1/245 2/209.13
2017/0086527 A1 * 3/2017 Corner ..... A42B 1/062

* cited by examiner

*Primary Examiner* — Tajash D Patel
(74) *Attorney, Agent, or Firm* — Viksnins Harris Padys Malen LLP

(57) ABSTRACT

A novelty hat containing one or more magnets, wherein the magnets are integrated into structure of the hat, whereby the wearer can hold small metallic or magnetic items in place on the hat by placing them on a location on the hat holding the one or more magnets.

14 Claims, 7 Drawing Sheets

NOVELTY HAT WITH MAGNETIC ATTACHMENT

FIELD OF INVENTION

This invention relates to the field of novelty headwear, and specifically to a hat with magnets integrated into the fabric of the hat for the purpose of holding metallic or magnetic items in place.

BACKGROUND

U.S. Pat. No. 5,107,548 by Dotzenrod shows a novelty cap such as a baseball cap to which a can holder (also known as a can cooler) is attached by Velcro or hook-and-loop style attachment strips. The point of the invention is to allow the wearer of the "cooler cap" to have convenient access to a can cooler without having to carry it with them in a hand or pocket. While the "cooler cap" is an interesting novelty, it has limitations.

The hook-and-loop attachment strips on the "cooler cap" are visible on the outside of the cap or the outside of the cooler when it is in place, and can detract from the attractiveness of the cap. Also, these strips have a tendency to collect matter over time, such as fibers from the cooler, hairs, dust, and other matter, and can wear out or lose their effectiveness.

The hook-and-loop strips of the "cooler cap" can also be hard to pull apart, forcing the user to remove the cap, hold it in one hand, and using the other hand to pull the attachment strips apart.

Finally, the reliance of the "cooler cap" on hook-and-loop strips is limiting, in that there are not a lot of items that have hook-and-loop strips already installed on them, so there is no convenient way to hold other items in place on the "cooler cap."

What is needed in the art is a novelty hat that can allow items to be attached to and stored on the exterior of the hat while avoiding visible attachment means, making it easier to remove the stored items from the hat, and allowing several different types of items to be stored on the hat.

SUMMARY

According to one of the present embodiments, a novelty hat will be described, wherein the novelty hat contains one or more magnets, wherein the magnets are integrated into structure of the hat, whereby the wearer can hold small metallic or magnetic items in place on the hat by placing them on a location on the hat holding the one or more magnets.

According to another of the embodiments, a novelty hat will be described, wherein the novelty hat contains one or more magnets, wherein the magnets are integrated into structure of the hat, whereby the wearer can hold a can holder containing magnets or metallic components in place on the hat by placing the can holder on the hat such that the magnets of the hat line up with the magnets or metallic components of the can holder.

In one or more embodiments, a novelty hat comprises a hat having a front, back, howl, and brim. At least one hat magnet embedded on or within a portion of the hat, and the hat further includes a can holder having one or more can holder magnets, the can holder coupled with the hat with the hat magnets and the can holder magnets. The can holder configured to be attached to itself with the one or more magnets when the can holder is removed from the hat.

In one or more embodiments, the magnets are neodymium magnets.

In one or more embodiments, the magnets have a size smaller than a nickel.

In one or more embodiments, the can holder includes a layer of foam.

In one or more embodiments, the magnets are embedded into the bowl of the hat.

In one or more embodiments, the magnets are embedded into the brim of the hat.

In one or more embodiments, the hat further includes one or more metallic items coupled with the brim of the hat via the hat magnet.

In one or more embodiments, the can holder is coupled with the back of the hat.

In one or more embodiments, the hat is a cowboy hat.

These aspects and others are achieved by the present invention, which is described in detail in the following specification and accompanying drawings which form apart hereof.

DETAILED DESCRIPTION

With reference now to the drawings, and in particular to FIGS. 1A through 7B thereof, a new novelty hat with magnetic attachment will be described.

In this document, references in the specification to "one embodiment", "an embodiment", "an example", "another embodiment", "a further embodiment", "another further embodiment," and the like, indicate that the embodiment described can include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one of ordinary skill in the art to affect such feature, structure, or characteristic in connection with other embodiments whether or not explicitly described.

In this document, the terms "a," "an," or "the" are used to include one or more than one unless the context clearly dictates otherwise. The term "or" is used to refer to a nonexclusive "or" unless otherwise indicated. In addition, it is to be understood that the phraseology or terminology employed herein, and not otherwise defined, is for the purpose of description only and not of limitation. Any use of section headings is intended to aid reading of the document and is not to be interpreted as limiting; information that is relevant to a section heading may occur within or outside of that particular section.

Furthermore, all publications, patents, and patent documents referred to in this document are incorporated by reference herein in their entirety, as though individually incorporated by reference. In the event of inconsistent usages between this document and those documents so incorporated by reference, the usage in the incorporated reference should be considered supplementary to that of this document; for irreconcilable inconsistencies, the usage in this document controls.

Figure 1A:
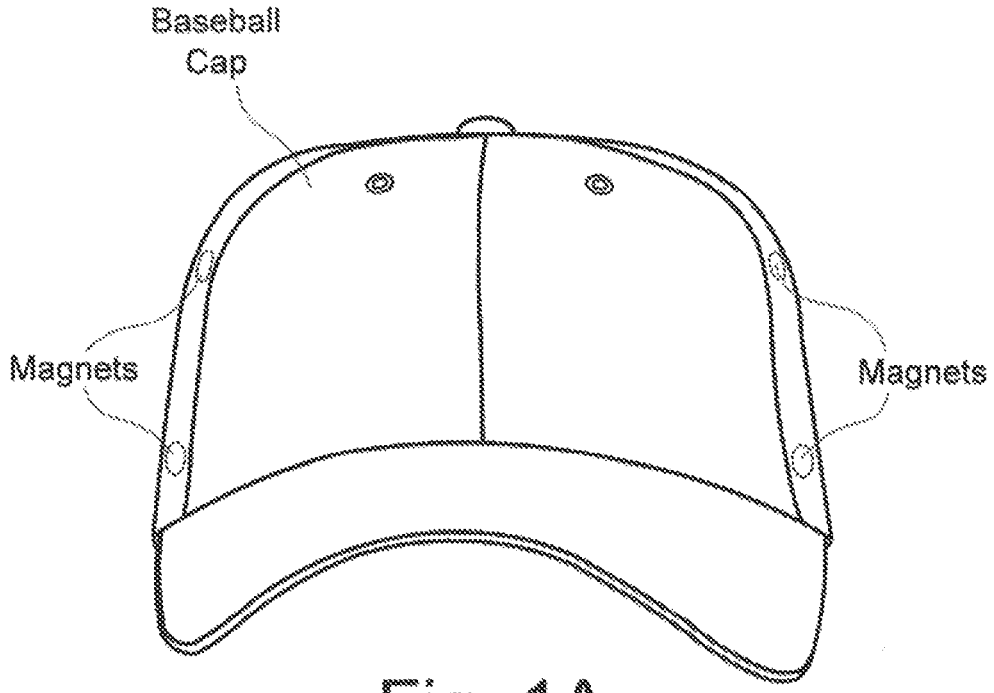
FIG. 1A is an illustration of one embodiment of the novelty hat of the present invention, showing how magnets can be integrated into the hat for the attachment of objects.

FIG. 1A is an illustration of one embodiment of the novelty hat of the present invention, showing how magnets can be integrated into the hat for the attachment of objects.

In FIG. 1A, we see a front view of one style of hat that can be used with the present invention, in this case a typical baseball cap. The baseball cap style lends itself well to the present invention, as the upper portion of the hat, the "bowl", has a front face (just above the bill of the cap) that is substantially vertical, offering the ideal resting and storage place for an item such as a can holder. However, the present invention will work well with many other styles of hats, including cowboy hats, fedoras, sun hats, porkpie hats, bowlers, etc.

Strong magnets are integrated into the hat. The magnets would typically be sewn into the layers of the hat or otherwise integrated into the structure of the hat, and would therefore not be externally visible, allowing the hat to look like a normal hat when nothing it attached to the hat. The magnets are shown in the figures herein as dashed line circles, indicating the magnets are normally hidden from view and embedded in the layers of the hat itself.

In order to work effectively, the magnets used for this invention must be strong enough to hold an item in place and yet small enough not to affect the size and weight of the hat noticeably. One such type of magnet available today is a neodymium magnet.

A neodymium magnet (also known as NdFeB, NIB or Neo magnet) is a permanent, rare-earth magnet made from an alloy of neodymium, iron and boron to form the Nd2Fe14B tetragonal crystalline structure. Neodymium magnets were first developed in 1982 by General Motors and Sumitomo Special Metals. They are the strongest type of permanent magnet commercially available. When first developed, neodymium magnets were expensive, and would not have been an obvious choice for an application such as a novelty hat. Only relatively recently has the widespread adoption of the neodymium magnet allowed it to be a practical option for the present invention.

The neodymium magnets are strong enough that small magnets, the size and shape of a nickel or smaller, can be used to attach items to a hat. This size of magnet is ideal for sewing into or otherwise integrating into the structure of a hat.

Although neodymium magnets are discussed here, any appropriate type of magnet may be used to attach an item to the hat.

Figure 1B:
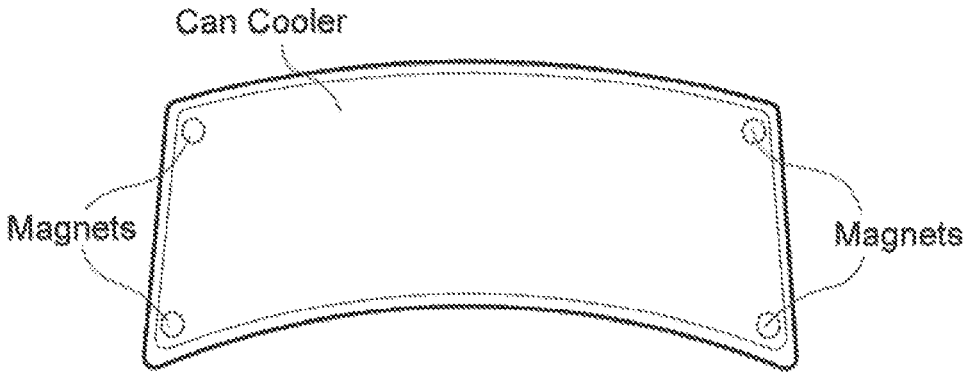
FIG. 1B is an illustration of one embodiment of a can holder that can be wrapped around a beverage can and attached to itself with magnets.

FIG. 1B is an illustration of one embodiment of a can holder, also known as a can cooler, that can be wrapped around a beverage can and attached to itself with magnets. In this embodiment, magnets are integrated into the can holder such that the locations of the magnets correspond to the locations of magnets in the novelty hat, such that, when the can holder is put in place on the front of the bowl of the hat, the magnets of the can holder attach to the magnets of the hat and hold it in place. A typical can holder of this style is constructed of fabric or insulating material such as form sandwiched between layers of fabric. The magnets can easily be held in place in pockets sewn into the layers of fabric of the can holder.

The material of the can holder can be made to match the material of the front of the bowl of the hat, such that when it is held in place, it will appear to be a part of the hat. Because the can holder essentially becomes the new front face of the hat when it is in place, graphics can be placed on the exterior surface of the can holder, allowing the wearer of the hat to change the look of the hat or the message printed on it simply by placing a different can holder in place. One can holder may have two different logos or messages printed on it, one on each side, allowing the user to flip the can holder over to easily change the appearance of the hat.

Figure 2:
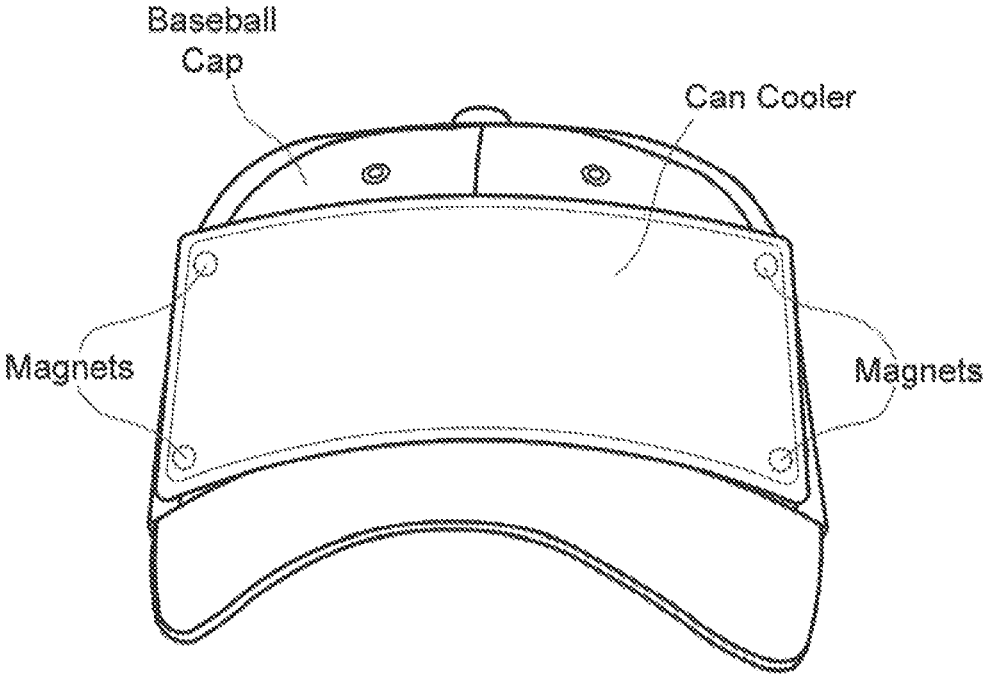
FIG. 2 is an illustration showing the can holder held in place on the exterior of the novelty hat with the magnets integrated into each piece.

FIG. 2 is an illustration showing the can holder held in place on the exterior of the novelty hat with the magnets integrated into each piece. The magnets of the can holder (visible, as the can holder is on top) are lined up with the magnets in the hat (which are not visible, as the can holder is covering them in this view.) When the can holder is brought up to be put in place on the hat, the magnets will naturally pull the can holder into the proper position on the hat, snapping the magnets of the can holder to the magnets of the hat. The orientation of the magnets is important, as magnets have "poles." The north pole of one magnet is attracted by the opposite, or south, pole of another magnet, and like poles will repel each other.

Figure 3A:
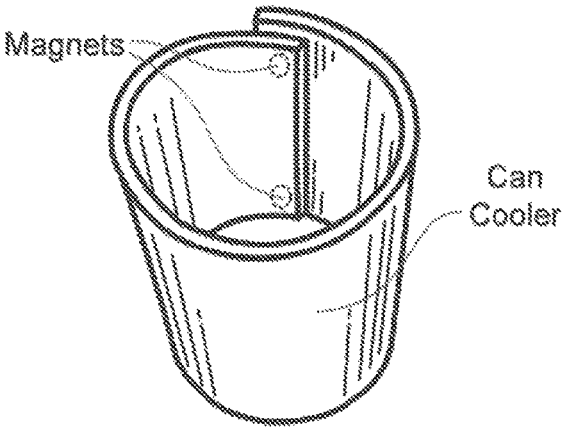
FIG. 3A is an illustration of how the can holder of FIG. 1B can be wrapped into a cylinder shape and attached to itself with magnets.

FIG. 3A is an illustration of how the can holder in FIG. 1B can be wrapped into a cylinder shape and attached to itself with magnets. If the can holder is formed into a cylinder shape (typically by wrapping it around a soda can), the magnets on one end of the rectangular can holder will be attracted to the magnets on the other end of the can holder, allowing the can holder to close and be held in place around a can or bottle.

Again, the orientation of the magnets in the can holder are important, so that the magnets on one side of the can holder are attracted to, not repelled by, the magnets in the other side of the can holder.

It should be noted that hook-and-loop strips can be used on the can holder, as in a traditional can holder, in addition to the magnets. The hook-and-loop strips could be used instead of the magnets when forming the can holder around a can or bottle. However, this defeats the purpose of eliminating the hook-and-loop strips as a means of attaching the can holder to the hat in the first place. However, there is nothing to prevent the use of hook-and-loop strips as a means to close the can holder in the present invention.

Figure 3C:
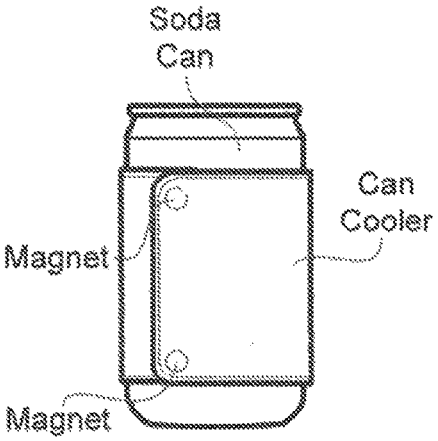
FIG. 3C is an illustration of the can holder closed and wrapped around the can, attached to itself with magnets.
Figure 3B:
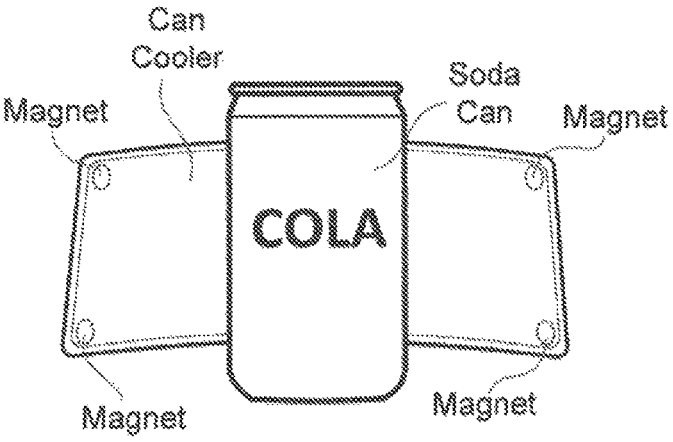
FIG. 3B is an illustration of can holder in place behind a soda can, before it is wrapped around the can.

FIG. 3B is an illustration of can holder in place behind a soda can, before it is wrapped around the can. The can holder would be sized such that the length of the can holder allows it to wrap around the outer diameter of the soda can such that the magnets of one end match up with the magnets of the other end, holding the can holder snugly in place around the soda can.

FIG. 3C is an illustration of the can holder closed and wrapped around the can, attached to itself with magnets. This view is shown primarily for completion, showing the final configuration of the can holder when it is in place around the soda can. The can holder should hug the can or bottle snugly enough that it is held in place and will not slip down or let the can or bottle fall out when the can holder is picked up. The can holder can be made to accommodate cans and bottle of different sizes by using more than one set of magnets on each end of the can holder, such that the closed configuration of the can holder holds each size of can or bottle snugly.

Figure 4:
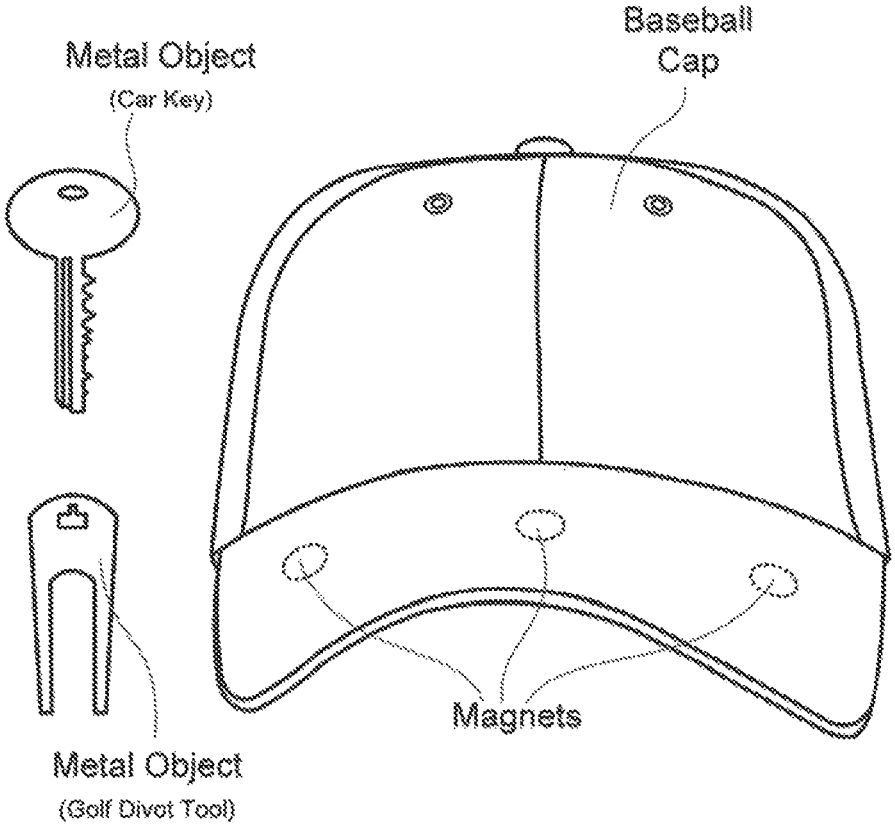
FIG. 4 is an illustration of an alternate embodiment of the novelty hat of the present invention, showing the magnets integrated into the brim of the novelty hat instead of the bowl of the hat so that small metallic items can be held in place.

FIG. 4 is an illustration of an alternate embodiment of the novelty hat of the present invention, showing the magnets integrated into the brim of the novelty hat instead of the bowl of the hat so that small metallic items can be held in place. Small metal items, such as the car key or golf divot tool shown in FIG. 4, can be placed over one or more of the magnets in the bill of the cap and held in place by the magnetic attraction to the metal.

Figure 5:
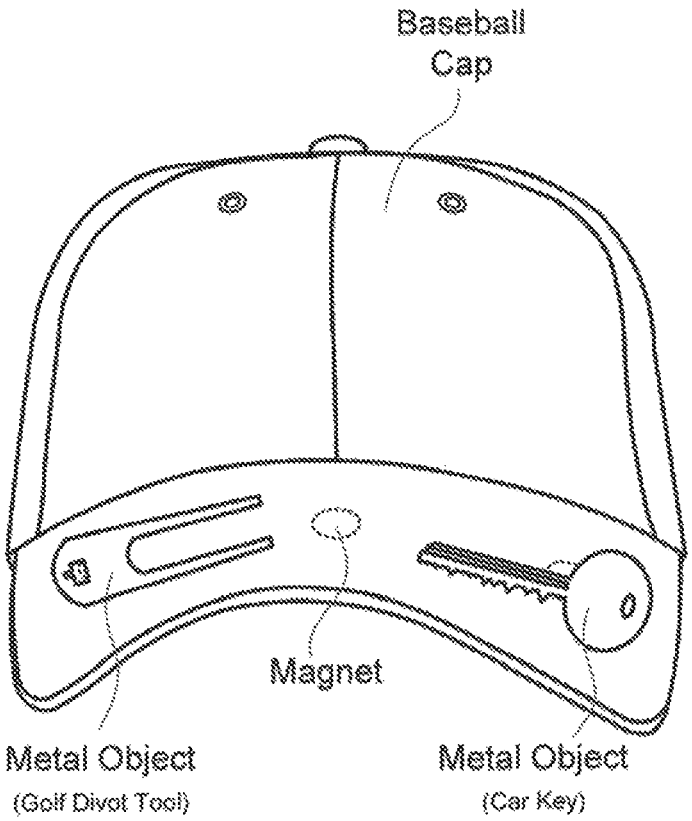
FIG. 5 is an illustration of small metallic items attached to the brim of the alternate embodiment of the novelty hat of FIG. 4.

FIG. 5 is an illustration of the small metallic items attached to the brim of the alternate embodiment of the novelty hat of FIG. 4. The use of strong magnets, such as the neodymium magnets discussed above, will hold most small metallic items in place even when the wearer of the hat is moving around doing ordinary activities.

It should be noted that the magnets can be placed in other locations to hold small metallic items, other than the bill as shown in FIGS. 4 and 5. For example, items could be attached to the bowl of the hat as well as the bill.

It should also be noted that the items that will be held in place by the magnets in the hat must be ferromagnetic. That is, they must be made of a metal that is able to be attracted to a magnet. Such metals typically include iron, nickel, cobalt, some alloys of rare earth metals, and some naturally occurring minerals such as lodestone in their-construction.

Figure 6A:
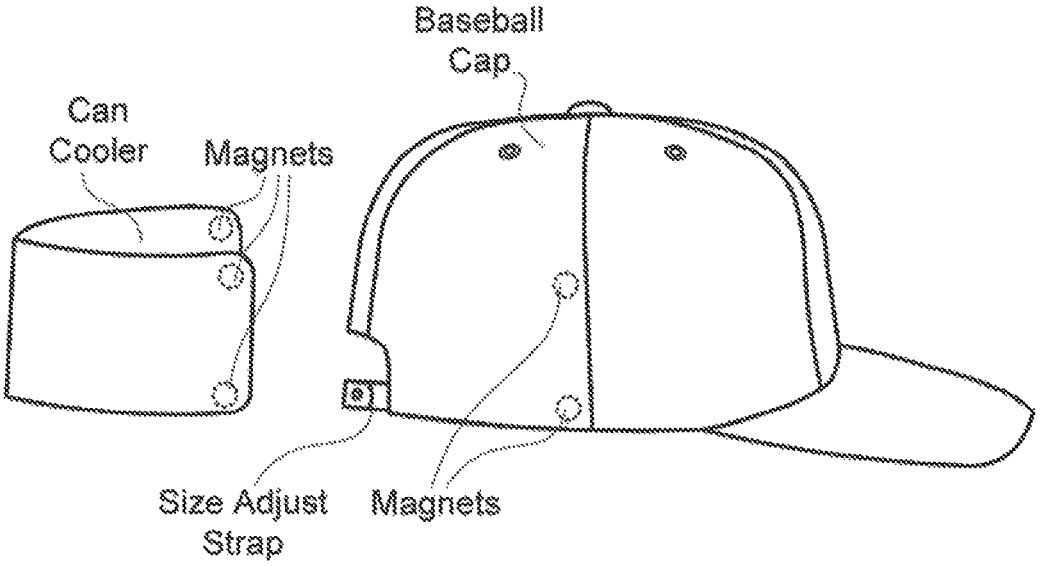
FIG. 6A is an illustration of another alternate embodiment of the novelty hat of the present invention, showing how the can holder may be wrapped around the back side of the bowl of the hat instead of the front.

FIG. 6A is an illustration of another alternate embodiment of the novelty hat of the present invention, showing how the can holder may be wrapped around the back side of the bowl of the hat instead of the front. The concepts previously explained in this specification for the embodiments of the invention where the can holder is placed on the front of the hat apply here, with the only difference being the location of the can holder when it is placed on the hat.

Figure 6B:
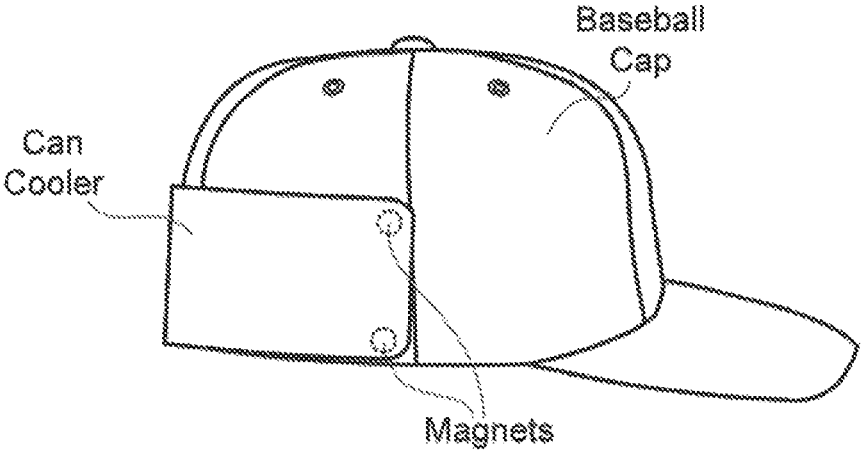
FIG. 6B is an illustration of an alternate embodiment of the novelty hat of the present invention of FIG. 6A, showing the can holder in place on the back of the hat.

FIG. 6B is an illustration of an alternate embodiment of the novelty hat of the present invention of FIG. 6A, showing the can holder in place on the back of the hat. There may be advantages to placing the can holder on the back of the hat instead of the front. One such advantage is that the can holder could be used to hide the size adjust strap (as shown on FIG. 6A) often used on baseball hats to allow the hat to be adjusted for different sizes of head. Another advantage would be that an additional message or logo could be placed on the back of the hat by printing it on the exterior surface of the can holder.

Figure 7A:
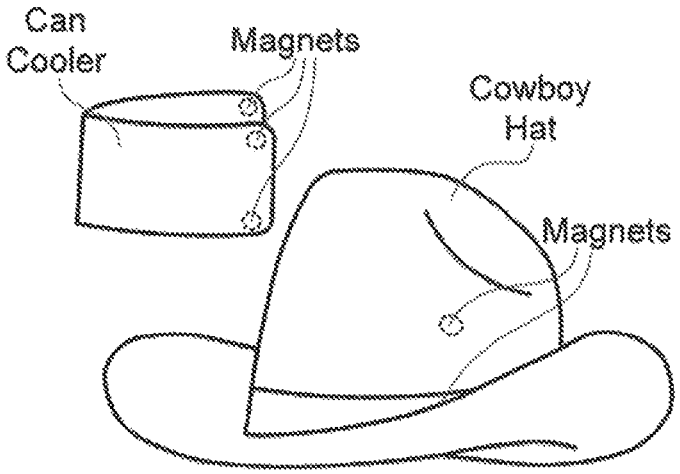
FIG. 7A is an illustration of yet another alternate embodiment of the novelty hat of the present invention, showing how the magnets can be integrated into different styles of hats, in this case a cowboy hat.

FIG. 7A is an illustration of yet another alternate embodiment of the novelty hat of the present invention, showing how the magnets can be integrated into different styles of hats, in this case a cowboy hat.

Figure 7B:
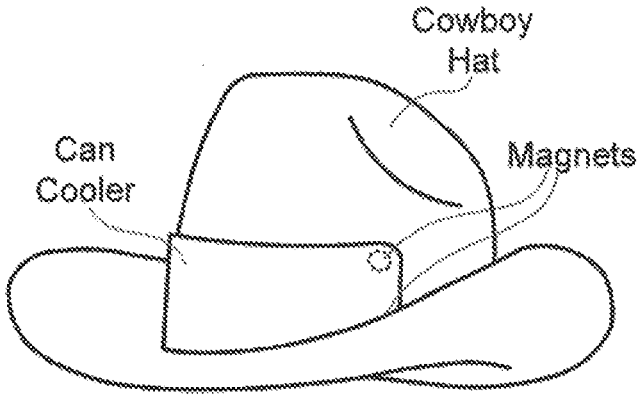
FIG. 7B is an illustration of the alternate embodiment of the novelty hat of FIG. 7A showing the can holder in place on the cowboy hat.

FIG. 7B is an illustration of the alternate embodiment of the novelty hat of FIG. 7A showing the can holder in place on the cowboy hat. Magnets could be integrated into the bowl, brim, and band of a hat, allowing can coolers and/or other metal or magnetic items to be held in place on the exterior of the hat.

FIGS. 7A and 7B are included for illustrative purposes only, showing that hat types other than the baseball cap shown in the previous examples can be used in the present invention.

Additional features and alternate embodiments are possible without deviating from the intent of the inventive concept described here. As previously stated, there are several styles of hat that could be used in the present invention. Also, there are many types of items that can be held to a hat by magnets. Any small metallic item or item with magnets integrated into it could be held to the hat, provided the items were not overly heavy or bulky, such that they affect the wearer's ability to wear the hat comfortably. For example, a small LED light could be mounted to the bill or brim of a hat to provide light as needed for working or to illuminate the way ahead.

The embodiments have been described in detail with particular reference to certain embodiments thereof, but it will be understood that variations and modifications can be effected within the scope of the embodiments, especially to those skilled in the art. It should be noted that embodiments or portions thereof discussed in different portions of the description or referred to in different drawings can be combined to form additional embodiments of the present invention. The scope of the invention should, therefore, be determined with reference to the appended claims, along with the full scope of equivalents to which such claims are entitled.

What is claimed is:

1. A novelty hat comprising:

a hat; and two or more hat magnets, wherein the two or more hat magnets are integrated and concealed into structure of the hat, wherein the two or more hat magnets are embedded into a bowl of the hat;

whereby a wearer of the hat can hold small metallic or magnetic items in place on the hat by placing them on the bowl of the hat; and an insulative can holder extending from a first end to a second end, wherein the can holder has been fabricated to contain can holder magnets at the first end and the second end, the can holder magnets are attracted to the two or more hat magnets, whereby the can holder can be placed on the hat and held in place by the two or more hat magnets and the can holder magnets.

2. The novelty hat of claim 1, wherein the two or more hat magnets and the can holder magnets are neodymium magnets.

3. The novelty hat of claim 1, wherein the two or more hat magnets and the can holder magnets have a size smaller than a nickel.

4. The novelty hat of claim 1, wherein the can holder includes a layer of foam.

5. The novelty hat of claim 1, wherein the can holder is coupled with a back portion of the hat.

6. The novelty hat of claim 1, wherein the hat is a cowboy hat.

7. A novelty hat comprising:

a hat having a front, back, bowl, and brim;

at least two hat magnets embedded on or within a portion of the hat;

a can holder having one or more can holder magnets, the can holder being insulative, the can holder extending from a first end to a second end, at least one of the at least two hat magnets disposed at the first end and the second end of the can holder, the can holder coupled with the hat with the at least two hat magnets and the can holder magnets;

the can holder configured to be attached to itself with the one or more can holder magnets when the can holder is removed from the hat; and wherein the at least two hat magnets are embedded and concealed into the bowl of the hat.

8. The novelty hat of claim 7, wherein the at least two hat magnets and the one or more can holder magnets are neodymium magnets.

9. The novelty hat of claim 7, wherein the at least two hat magnets and the one or more can holder magnets have a size smaller than a nickel.

10. The novelty hat of claim 7, wherein the can holder includes a layer of foam.

11. The novelty hat of claim 7, further comprising at least one brim hat magnet embedded into the brim of the hat.

12. The novelty hat of claim 11, further comprising one or more metallic items coupled with the brim of the hat via the at least one brim magnet.

13. The novelty hat of claim 7, wherein the can holder is coupled with the back of the hat.

14. The novelty hat of claim 7, wherein the hat is a cowboy hat.

* * * * *